US009085161B2

(12) United States Patent
Gloster et al.

(10) Patent No.: US 9,085,161 B2
(45) Date of Patent: Jul. 21, 2015

(54) SYSTEMS, STRUCTURES AND ASSOCIATED PROCESSES FOR INLINE ULTRASONICATION OF INK FOR PRINTING

(71) Applicant: ELECTRONICS FOR IMAGING, INC., Foster City, CA (US)

(72) Inventors: Daniel F. Gloster, Meredith, NH (US); Paul Andrew Edwards, Saline, MI (US); Lianhui Cong, Concord, NH (US); Michael R. Quint, Alexandria, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 0 days.

(21) Appl. No.: 13/913,293

(22) Filed: Jun. 7, 2013

(65) Prior Publication Data

US 2014/0362149 A1 Dec. 11, 2014

(51) Int. Cl.
*B41J 2/19* (2006.01)
*B41J 2/17* (2006.01)

(52) U.S. Cl.
CPC . *B41J 2/1707* (2013.01); *B41J 2/19* (2013.01)

(58) Field of Classification Search
CPC ..... B41J 2/19
USPC ..... 347/92
See application file for complete search history.

(56) References Cited

U.S. PATENT DOCUMENTS 3,904,392 A * 9/1975 Vanlngen et al. ..... 95/30
6,089,702 A 7/2000 Hilton
6,481,836 B1 11/2002 Paroff et al.
7,097,287 B2 * 8/2006 Nakao et al. ..... 347/85
7,344,236 B2 3/2008 Morimoto
7,470,547 B2 12/2008 Tisone et al.
7,559,615 B2 7/2009 Eve
7,654,414 B2 2/2010 Hiranaga et al.
7,901,063 B2 3/2011 Wouters et al.
7,992,979 B2 * 8/2011 Horie ..... 347/85

OTHER PUBLICATIONS

Ultrasonic Cleaning Primer, copyright Branson Ultrasonics Corporation 1998 ("Branson") (http://www.aqueoustech.com/aqueous%20university/knowledge-base/industry/Ultrasonic%20Cleaning%20Primer.pdf).*

* cited by examiner

*Primary Examiner* — Alessandro Amari
*Assistant Examiner* — Michael Zonczal
(74) *Attorney, Agent, or Firm* — Michael A. Glenn; Perkins Coie LLP

(57) ABSTRACT

Enhanced printing systems, structures, and processes provide ultrasonication of ink, such as to degas the ink, and/or to maintain the size of particles within the ink. At least one ultrasonic module, such as comprising any of an ultrasonic probe or an ultrasonic bath, is located within an ink delivery system. Ink is delivered to the ultrasonic module, and ultrasonic energy is applied to the ink, such as at a sufficient level and duration to degas the ink, and/or to reduce the size of particles within the ink. In some embodiments, the particles may be agglomerates, wherein the applied energy is configured to reduce the size of the agglomerates to a size that can be jetted through the print head. In other embodiments, the particles may be metallic particles, wherein the applied energy is configured to create smaller metallic particles that can be jetted with the ink through the print head.

24 Claims, 8 Drawing Sheets

SYSTEMS, STRUCTURES AND ASSOCIATED PROCESSES FOR INLINE ULTRASONICATION OF INK FOR PRINTING

FIELD OF THE INVENTION

The invention relates to the field of printing systems, structures, and associated processes. More particularly, the invention relates to systems, structures and processes that apply ultrasonic energy to liquid ink.

BACKGROUND OF THE INVENTION

Gas located within a fluid is compressible. Within a printing system, if a fluid ink contains one or more gasses, fluid ink to be ejected under pressure from an ink nozzle can therefore be compressed, due to the presence of gas, such that the ink may not jet correctly. Therefore, the presence of gas in a fluid ink that is intended for pressurized ejection reduces the reliability of producing an ejected droplet. In many such scenarios, the ink does not jet at all. Therefore, the presence of gas in a liquid ink can have a very large negative impact upon ink jetting, such as but not limited to the loss of printed material, which can be both costly and frustrating.

Vacuum degasification has previously been used in some printing systems. FIG. 1 is a schematic view of an exemplary conventional exemplary printing system 10 having inline vacuum degasification. Ink 14*a*, such as stored within an ink supply reservoir 12, e.g. a cartridge or tank, is transported 16 through a vacuum degasification module 18. A vacuum source 20, e.g. a pump or venturi, is also typically connected 22 to the vacuum degasification module 18, which applies a vacuum to the ink 14*a* within the vacuum degasification module 18, thereby extracting one or more gasses from the incoming ink 14*a*, producing degassed ink 14*b*, which is delivered 24 to a print head 26, wherein the print head 26 is configured to controllably jet 28 the degassed ink 14*b* onto a substrate 30.

Some conventional vacuum degassing modules are available through DIC Corporation, of Tokyo, Japan, wherein different modules are specified based on the type of ink to be jetted, the capacity, and the desired level of degassing. Other degassing devices are available through Membrana Inc., of Charlotte, N.C. A wide range of filter capsules is also available through Pall Corporation, of Port Washington, N.Y.

While vacuum degasification has previously been used to remove some gases from ink, such systems are often complex, and typically require a pressure source or a vacuum source.

It would therefore be advantageous to provide a mechanism that is configured to remove gasses that may be present in an ink at any point within a printing system, without requiring vacuum degasification and related hardware. The development of such a system or structure would be a major technological breakthrough.

Sonication has been used previously in applications other than printing, to break down larger particles into smaller particles. For example, ultrasonic energy has previously been used to break down kidney stones in a medical environment.

Besides problems with resident gasses, particulates in an ink supply have also posed numerous problems. For example, nozzle clogging due to particulates is a common print head failure mode in printing systems. Particulates, such as but not limited to agglomerated particles, are often present within an ink, or may occur within an ink delivery system, in a printing environment. While relatively small particles may pass though an ink delivery system, and be jetted through an inkjet print head along with the liquid ink, larger particles can easily build up within ink delivery circuits, and often clog print heads and associated pathways, e.g. within one or more nozzle plates.

It would therefore be advantageous to provide a mechanism and associated process that is capable of breaking down the size of particulates that may be present in an ink, at any point within a printing system, to prevent fouling. The development of such a system, structure, and associated process would provide a major technological advance.

In addition, while prior vacuum degasification systems may be configured to remove resident gases from an ink supply, such systems do not address other solids that may be present in the ink, such as agglomerated pigments.

It would therefore be advantageous to provide a system, structure, and associated process that is capable of both removing resident gases from an ink supply, and maintaining the size of particulates in the ink supply, at any point within a printing system. The development of such a system, structure, and associated process would constitute a further major technological breakthrough.

SUMMARY OF THE INVENTION

Enhanced printing systems, structures, and processes provide ultrasonication of ink, such as to degas the ink, and/or to maintain the size of particles within the ink. At least one ultrasonic module, such as comprising any of an ultrasonic probe or an ultrasonic bath, is located within an ink delivery system. Ink is delivered to the ultrasonic module, and ultrasonic energy is applied to the ink, such as at a sufficient level and duration to degas the ink, and/or to reduce the size of particles within the ink. In some embodiments, the particles may be agglomerates, wherein the applied energy is configured to reduce the size of the agglomerates to a size that can be jetted through the print head. In other embodiments, the particles may be metallic particles, wherein the applied energy is configured to create smaller metallic particles that can be jetted with the ink through the print head.

DETAILED DESCRIPTION OF PREFERRED EMBODIMENTS

Figure 1:
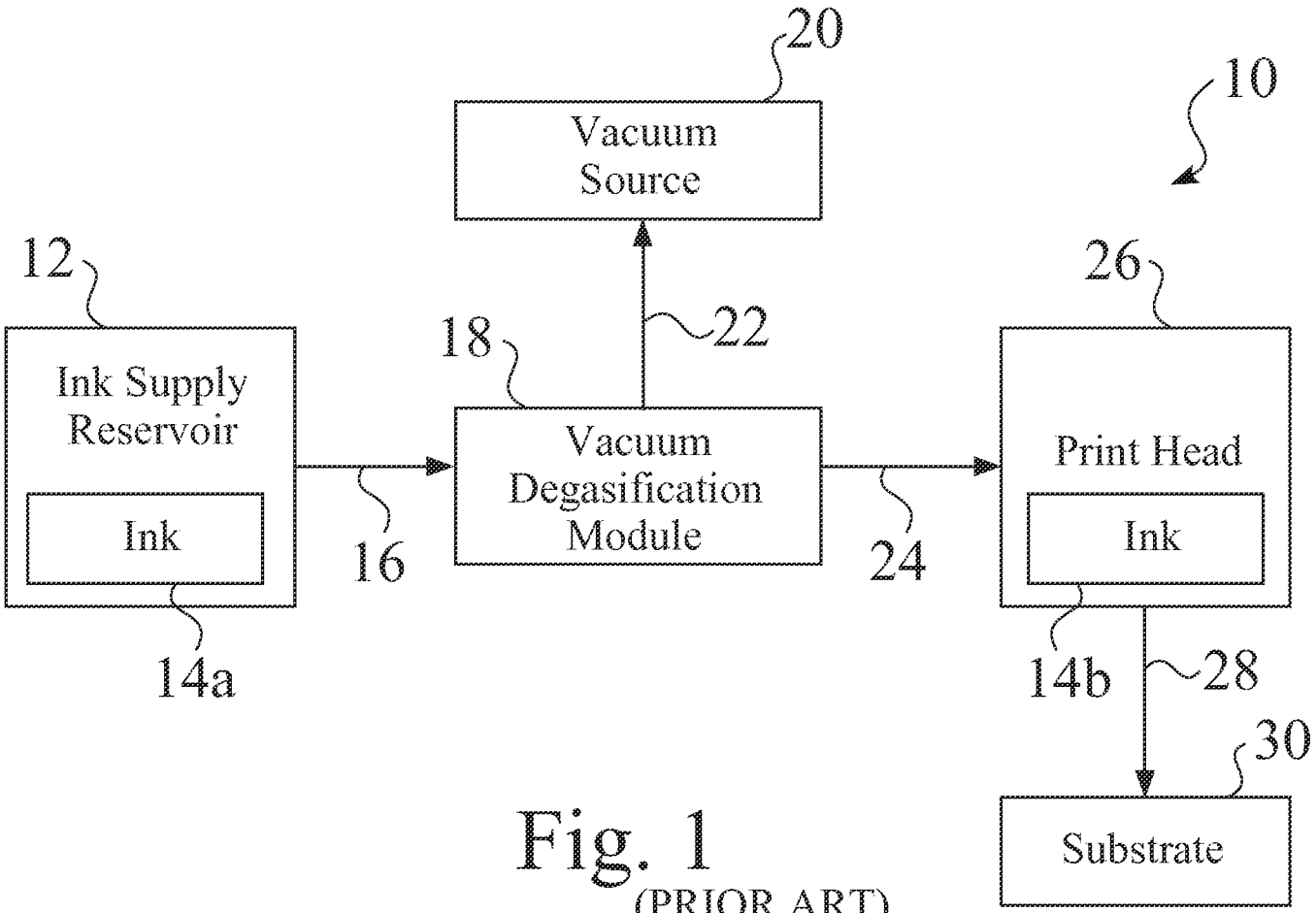
Fig. 1 (PRIOR ART)
FIG. 1 is a schematic diagram of an exemplary prior art printing system having inline ink vacuum degassing.
Figure 2:
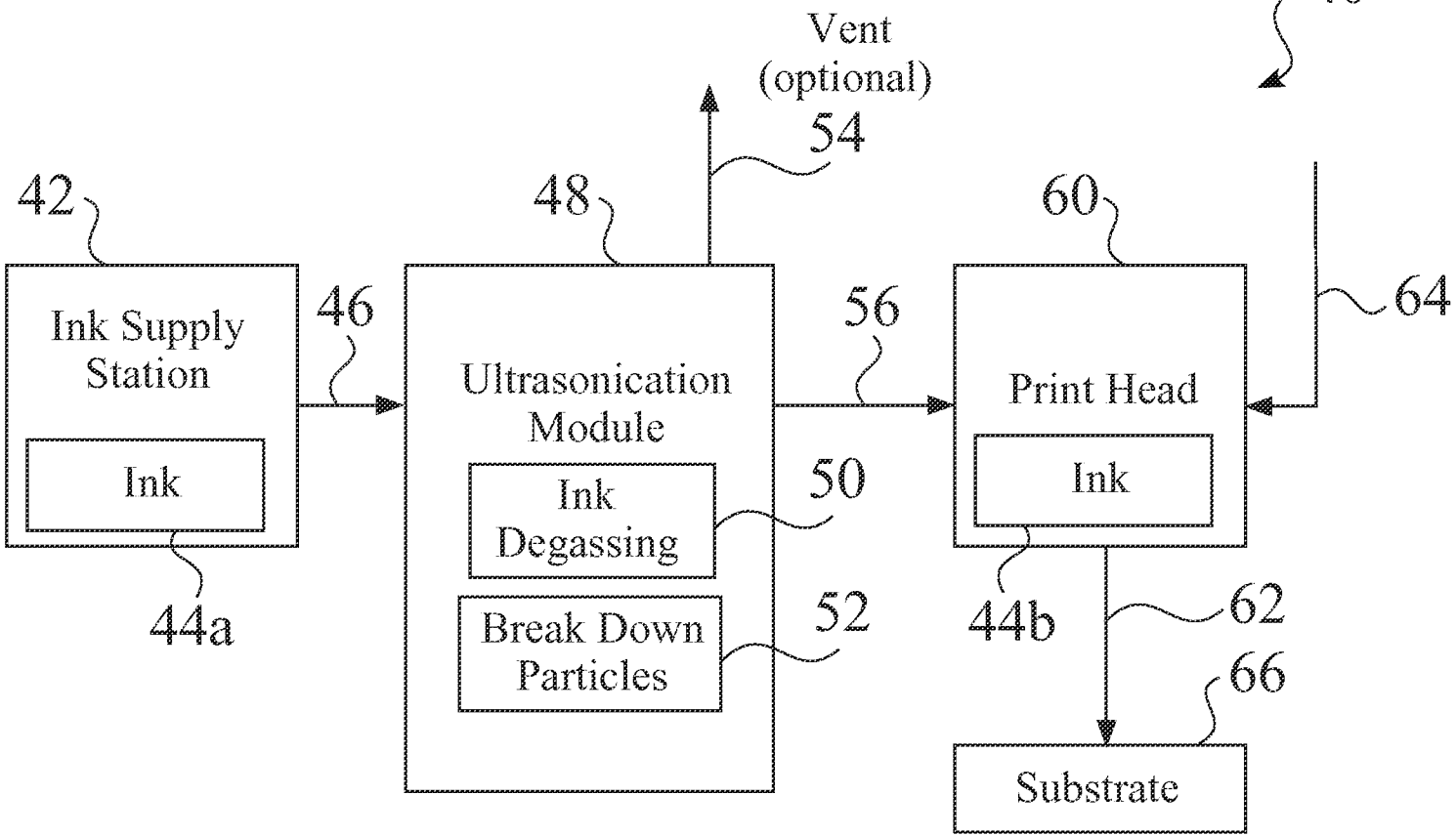
FIG. 2 is a schematic diagram of an exemplary enhanced printing system having ink ultrasonication.

FIG. 2 is a schematic diagram of an exemplary enhanced printing system 40 having an ultrasonic module 48, such as to ultrasonically degas 50 ink 44, e.g. 44*a*, and/or to ultrasonically break down 52 particles 146 (FIG. 5, FIG. 7), e.g. agglomerates, metallic particles, or other solids 146, which may be present within an ink 44*a*.

Figure 3:
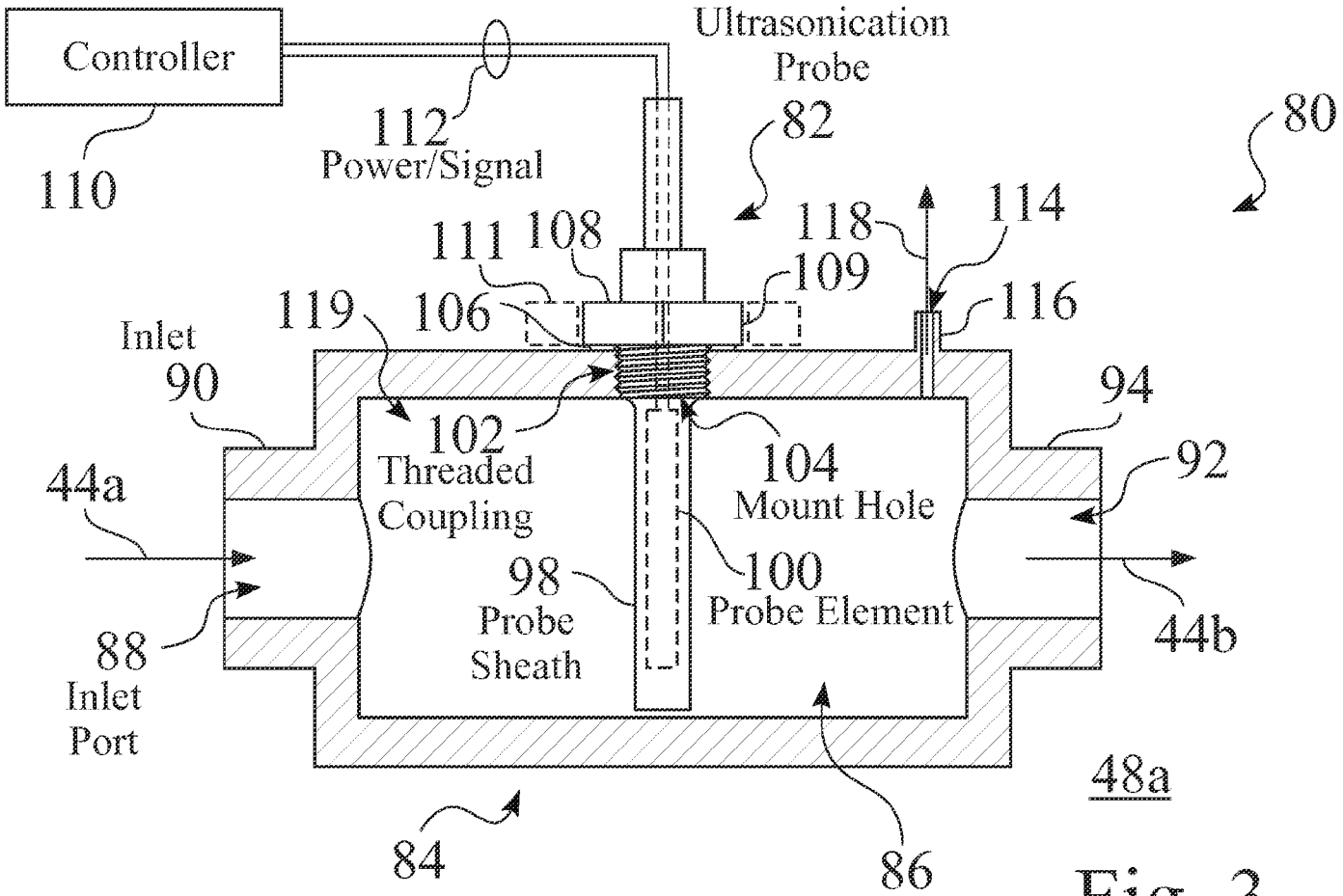
FIG. 3 is a detailed schematic view of an ultrasonication probe assembly associated with an ink transport or storage system.
Figure 4:
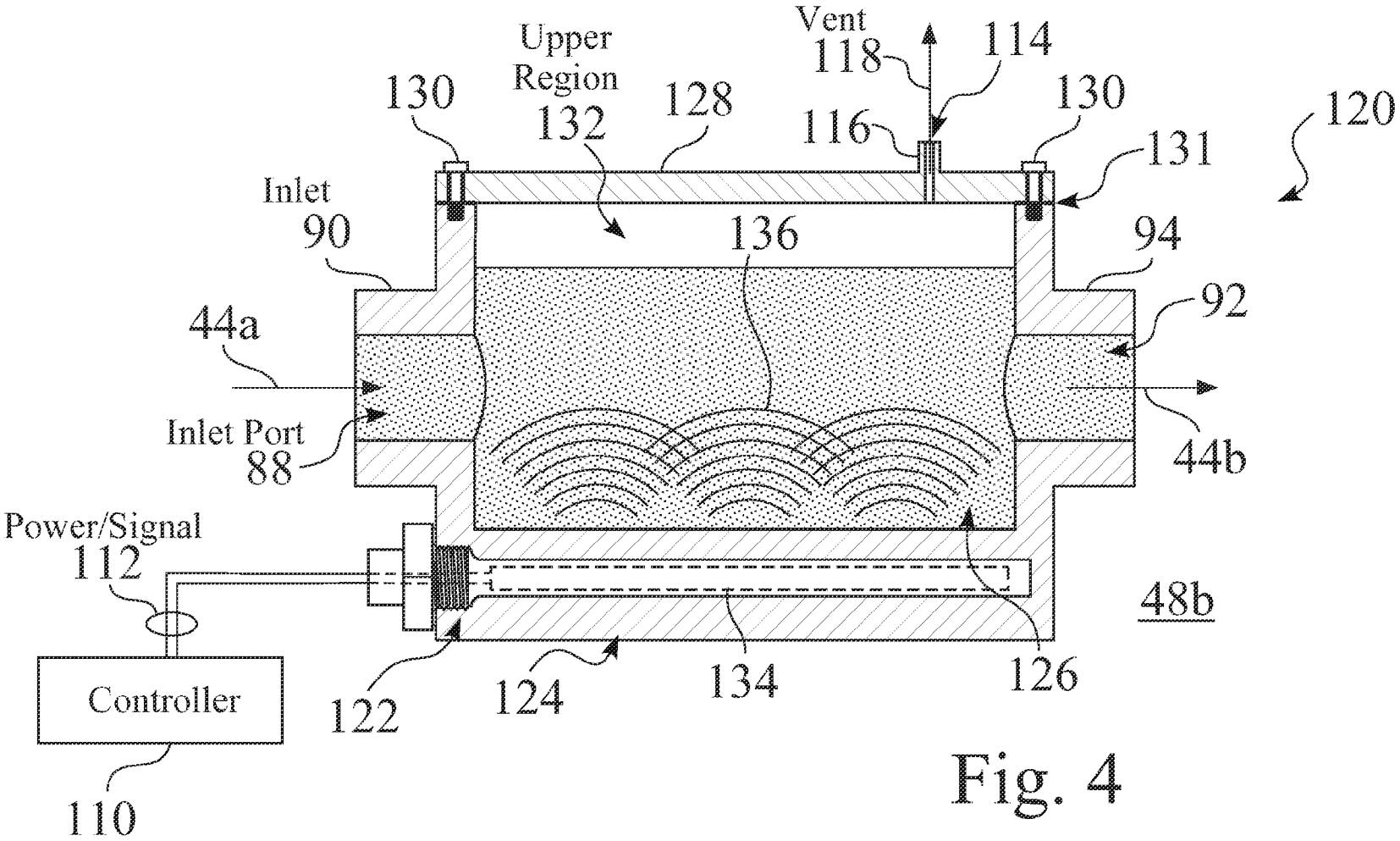
FIG. 4 is a detailed schematic view of an ultrasonication bath assembly associated with an ink transport or storage system.

Ink 44*a*, such as stored within an ink supply station 42, e.g. a reservoir, cartridge or tank 42, is transported 46 through one or more ultrasonic modules 48, such as past an ultrasonic probe assembly 48*a* (FIG. 3), and/or through an ultrasonic bath assembly 48*b* (FIG. 4). A vent 54 may preferably be provided, such as for an ultrasonic module 48*a* that provides degassing 50, to extract one or more gasses 162 (FIG. 6, FIG. 7) that are outgassed from incoming ink 44*a*, producing degassed ink 44*b*. The resultant conditioned ink 44*b* may preferably be delivered 56 to or through a corresponding print head 60, where the conditioned ink 44*b* may be jetted 62 or otherwise delivered onto one or more portions of a workpiece 66, e.g. a substrate, such as in response to a signal 64.

FIG. 3 is a detailed schematic view 80 of an ultrasonication probe assembly 48*a* associated with an enhanced printing system 40. The exemplary ultrasonication probe assembly 48*a* seen in FIG. 3 comprises a probe housing 84 having a chamber 86 defined therein, an inlet 90 having a corresponding inlet port 88, and an outlet 94 having a corresponding outlet port 92.

The exemplary ultrasonication probe assembly 48*a* seen in FIG. 3 further comprises an ultrasonication probe 82, which is affixed to the probe housing 84 and extends into the chamber 86. The exemplary ultrasonication probe 82 comprises a probe sheath 98 that extends into the ink chamber 86 from a threaded coupling 102, which is threadably engaged through a threaded probe mount hole 104. The exemplary ultrasonication probe 82 may further comprise a landing 108, such as having opposing faces 109, for engagement by a tool 111 that is configured to fasten the ultrasonication probe 82 to the housing 84. A washer, gasket, or seal 106 may preferably be provided between the landing 108 and the housing 84.

The exemplary ultrasonication probe 82 seen in FIG. 3 further comprises an ultrasonic probe element 100, such as located within the probe sheath 98, wherein the probe element 100 is connected 112 to a controller 110, such that the ultrasonication probe 82 may be controllably powered to provide ultrasonic energy 136 (FIG. 4) such as in the range of about 20 kHz to 400 kHz. In operation, when ink 44*a* enters the chamber 86 through the inlet port 88, the ultrasonic probe element 100 may be powered to ultrasonically treat the incoming ink 44.

The exemplary ultrasonication probe assembly 48*a* seen in FIG. 3 may further comprise a vent 116 having a gas outlet port 114, through which any gas 162 released though degassing 50 may be vented 118. The exemplary vent 116 and corresponding gas outlet port 114 seen in FIG. 3 is located toward an upper region 119 of the chamber 86, such that gasses 162 may be vented 118, without loss of ink 44, e.g. 44*a* or 44*b*.

FIG. 4 is a detailed schematic view 120 of an exemplary ultrasonication bath assembly 48*b* associated with an enhanced printing system 40. The exemplary ultrasonication assembly 48*b* seen in FIG. 4 comprises an ink bath housing 124 having a chamber 126 defined therein, an ink inlet 90 having a corresponding inlet port 88, and an ink outlet 94 having a corresponding outlet port 92. The exemplary ultrasonication bath assembly 48*b* seen in FIG. 4 also comprises a tank cover 128, which may be fastened 130 to the upper region 132 of the ink bath housing 124. A seal 131 may also be provided between the tank cover 128 and the tank housing 124, around the perimeter of the tank chamber 126.

The exemplary ultrasonication probe assembly 48*b* seen in FIG. 4 further comprises an ultrasonication module 122 that is affixed to the ink bath housing 124. The exemplary ultrasonication module 122 includes an ultrasonic probe element 134, which is connected 112 to a controller 110, wherein the ultrasonication module 122 may be controllably powered to provide ultrasonic energy 136 to ink 44*a* within the chamber 126. While the exemplary ultrasonication probe assembly 48*b* provides a schematic depiction of a corresponding ultrasonication mechanism 122, it should be understood that many configurations may be provided, such as to apply ultrasonic energy 136 from one or more directions into the chamber 126. In operation, when ink 44*a* enters the chamber 126 through the inlet port 88, the ultrasonic element 134 may controllably be powered to ultrasonically treat 136 the incoming ink 44*a*.

The volume of the chamber 126 may preferably be configured to allow sufficient storage of the ink 44 for a suitable time period, such as to provide an adequate residence time for any of ink degassing 50 or breakdown 52 of particles 146.

The exemplary ultrasonication probe assembly 48*b* seen in FIG. 4 may further comprise a vent 116 having gas outlet port 114, through which any gas 162 (FIG. 6, FIG. 7) released though degassing 50 may be vented 118. The exemplary vent 116 and corresponding gas outlet port 114 seen in FIG. 3 is located toward an upper region 132 of the chamber 126, which may preferably be integrated with a tank cover 128, wherein released gasses 162 may be vented 118, without loss of ink 44, e.g. 44*a* or 44*b*.

Figure 5:
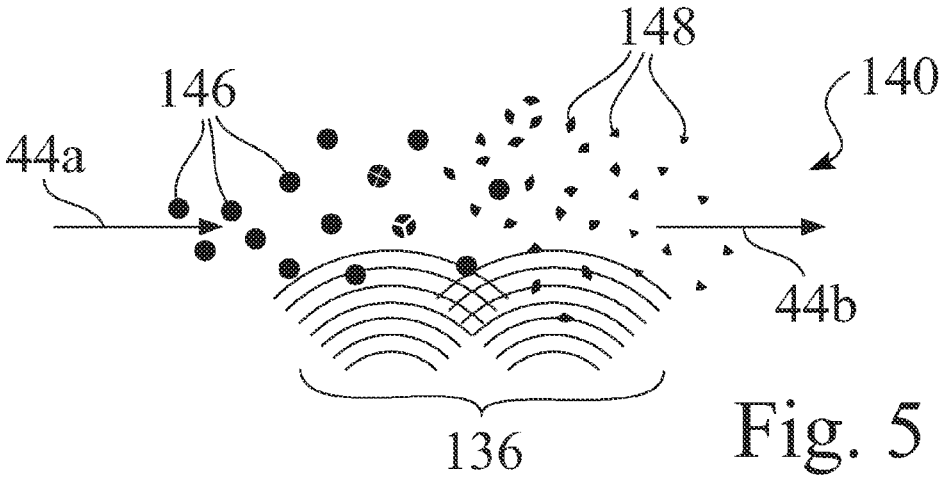
FIG. 5 is a schematic view of ultrasonication used to break down particles.

FIG. 5 is a schematic view 140 of ultrasonic energy 136, e.g. about 20 kHz to 400 kHz, used to break down 52 particles 146, e.g. agglomerates, metallic particles, or other solids 146, which may be present within an incoming ink 44*a*. As seen in FIG. 5, incoming ink 44*a* may contain one or more types of particles 146.

For example, the incoming ink 44*a* may contain undesired agglomerates 146, wherein the ultrasonic energy 136 may preferably be applied to break down and/or maintain the size of the agglomerates 146, e.g. to a level wherein the particles 146 may preferably be filtered or delivered, e.g. jetted 62.

In some embodiments, at least a portion of the particles 146 may comprise intended particles 146, e.g. metallic particles or pigments, wherein the ultrasonic energy 136 may preferably be applied to prepare the size of the pigments 146 for any of transport 56 (FIG. 2) or delivery, e.g. jetting 62 (FIG. 2). For example, metallic particles 146 may controllably be reduced in size to provide a desired metallic ink 44*b*. As well, the level of applied ultrasonic energy 136 may preferably be controllable 110, e.g. in magnitude or time, to produce different ink characteristics, e.g. such as but not limited to any of color, gloss, or opacity. The level of applied ultrasonic energy 136 may also preferably be controllable 110 to provide different ink characteristics based on different intended substrates 66, e.g. different paper types, finishes, films, surfaces, or any combination thereof. Furthermore, the applied ultrasonic energy 136 may also be controllable 110 based on other inputs, e.g. such as but not limited to temperature, humidity, or based on information related to the ink or carrier. For example, a product code may provide input that is associated with ultrasonic energy 136 that is required to break down included particles.

While the ultrasonication module 48 may be located at any point within a printing system 40, the ultrasonic energy 136 may preferably be applied just prior to printing 62. As well, ultrasonication energy 136 may preferably be applied to an ink 44*a* before delivery to a printing system 40, e.g. before delivery to the ink supply station 42, such as to maintain or prepare a new ink 44*a*, and/or to condition an older ink 44*a*.

Figure 6:
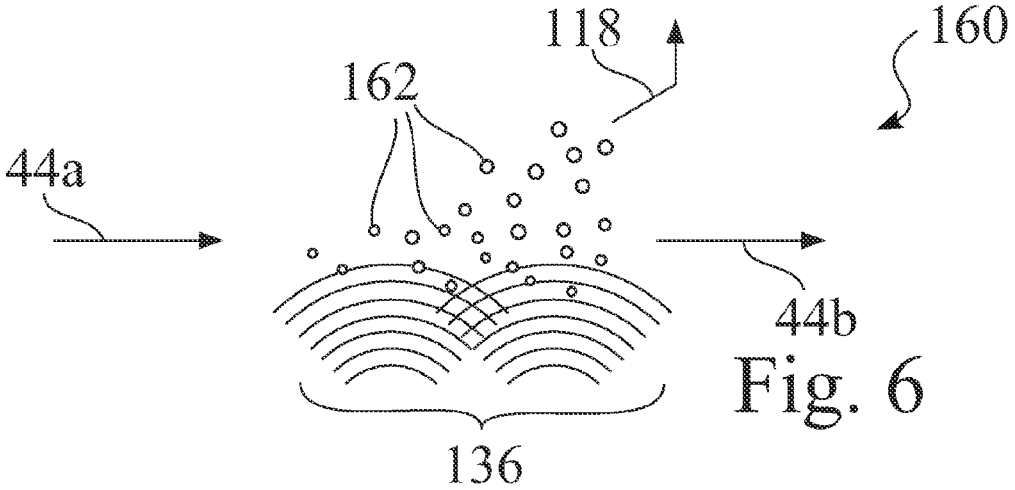
FIG. 6 is a schematic view of ultrasonication used to degas ink.

FIG. 6 is a schematic view 160 of ultrasonication energy 136 used to degas 50 ink 44*a*, wherein the gas 162 may typically comprise one or more gasses 162, such as but not limited to any of oxygen, air, water vapor, volatile carriers, or other resident gases 162.

Figure 7:
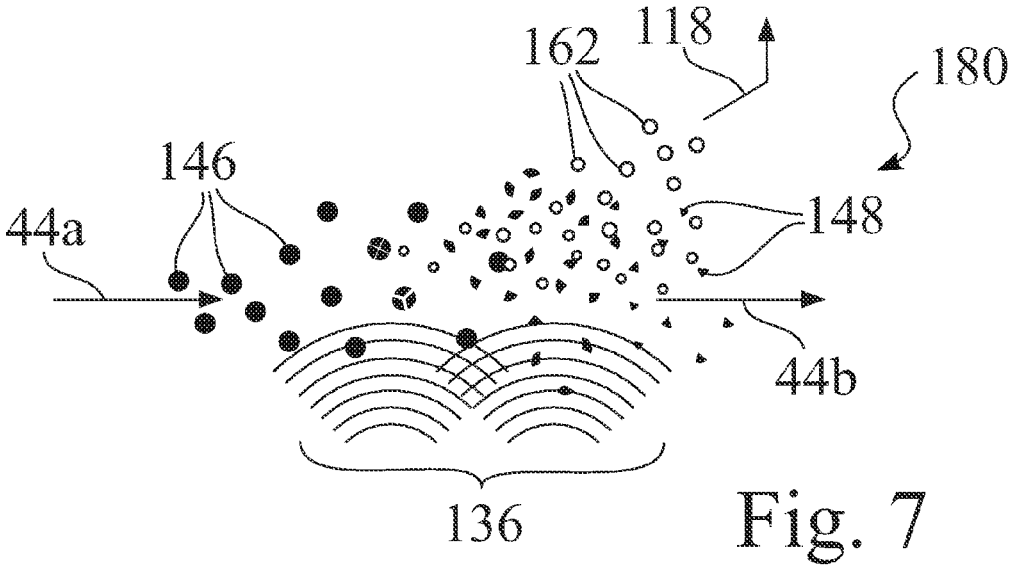
FIG. 7 is a schematic view of ultrasonication used for both particle size reduction and degassing of ink.

FIG. 7 is a schematic view 180 of ultrasonication energy 136 used for both particle size reduction and degassing of ink 44*a*. As seen in FIG. 2, FIG. 3, and FIG. 4, the exemplary enhanced printing system 40 may readily be configured to provide both ink degassing 50 and ink particle management 52, and thus can be implemented to provide comprehensive conditioning of ink 44 at one or more points in an ink delivery system.

Exemplary Performance of Degassing with Applied Ultrasonic Energy. An ultrasonic bath assembly 48*b* was used to test the degassing performance of an ultrasonic mechanism 48, wherein the ultrasonic bath assembly 48*b* comprised a Model 3510 Branson Ultrasonic Cleaner, available through Branson Ultrasonics Corp., of Danbury Conn., which has an overall size of 16 inches×12 inches×14.5 inches, a tank size of 11.5 inches×6 inches×6 inches, a weight of 12 pounds, and a frequency of 40 kHz.

Figure 8:
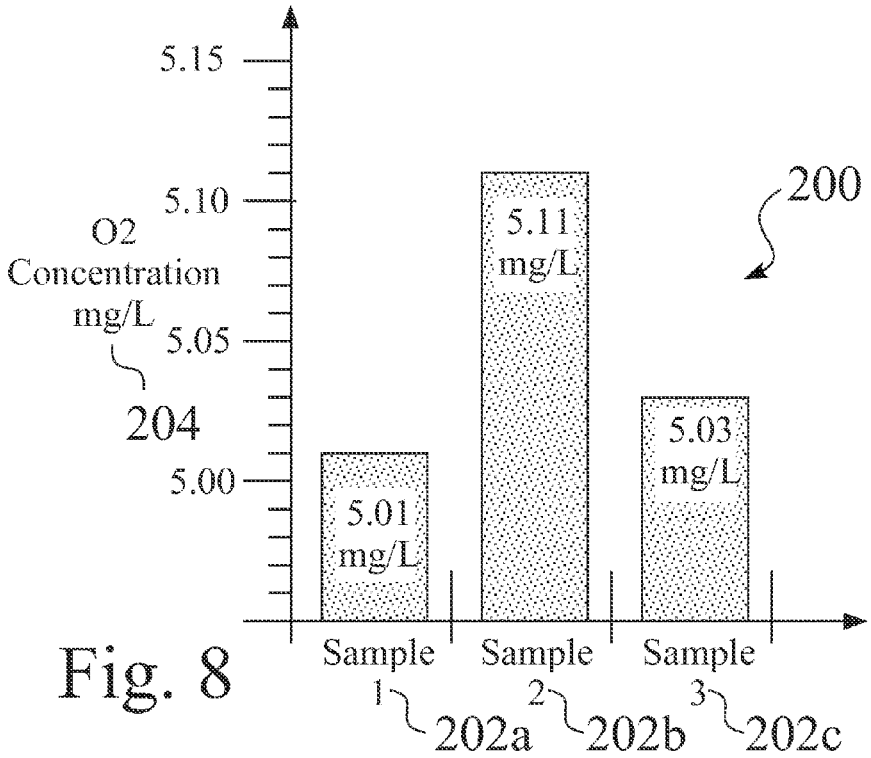
FIG. 8 is a chart that shows exemplary oxygen concentrations for three different ink samples, immediately after an interval of applied ultrasonic energy, for one embodiment of an ultrasonic bath.

FIG. 8 is a chart 200 that shows exemplary oxygen concentrations 204 for three different ink samples 202, e.g. 202*a*-202*c*, immediately after a 15 minute interval of applied ultrasonic energy 136, for one embodiment of an ultrasonic bath 44*b*. As seen in FIG. 8, a first sample 202*a* of ink 44 had an oxygen concentration of 5.01 mg/L, a second sample 202*b* of ink 44 had an oxygen concentration of 5.11 mg/L, and a third sample of ink 44 had an oxygen concentration of 5.03 mg/L. As seen in FIG. 8, the application of ultrasonic energy 136 in an ultrasonic bath 44*b* provides substantial removal of resident oxygen 162 within an ink 44.

Figure 9:
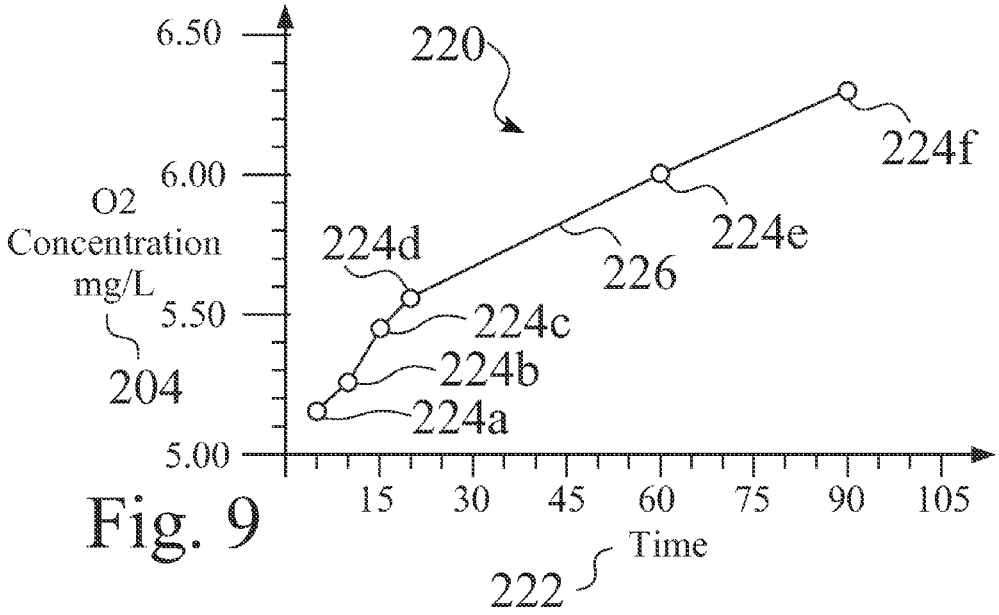
FIG. 9 is a chart showing oxygen concentration of an ink sample as a function of time after stopping an application of ultrasonic energy.

FIG. 9 is a chart 220 showing oxygen concentration 204 of an ink sample 44 as a function of time 222 after stopping the application of ultrasonic energy 136. A first data point 224*a* shows an ink concentration level of 5.14 mg/L at a time 222 of 5 minutes. A second data point 224*b* shows an ink concentration level of 5.24 mg/L at a time 222 of 10 minutes. A third data point 224*c* shows an ink concentration level of 5.44 mg/L at a time 222 of 15 minutes. A fourth data point 224*d* shows an ink concentration level of 5.56 mg/L at a time 222 of 20 minutes. A fifth data point 224*e* shows an ink concentration level of 6.01 mg/L at a time 222 of 60 minutes. A sixth data point 224*f* shows an ink concentration level of 6.31 mg/L at a time 222 of 90 minutes. Line 226 shown in FIG. 9 is a plot of approximated performance based on the measured results 224*a*-224*f*.

As seen in FIG. 9, an ink 44 that is degassed 50 slowly reabsorbs gasses 162, if exposed to the gasses. In some printing system environments, therefore, it may be preferred to position an ultrasonic assembly 44 close to the corresponding print heads 62, to avoid reabsorption of any gasses 162.

Figure 10:
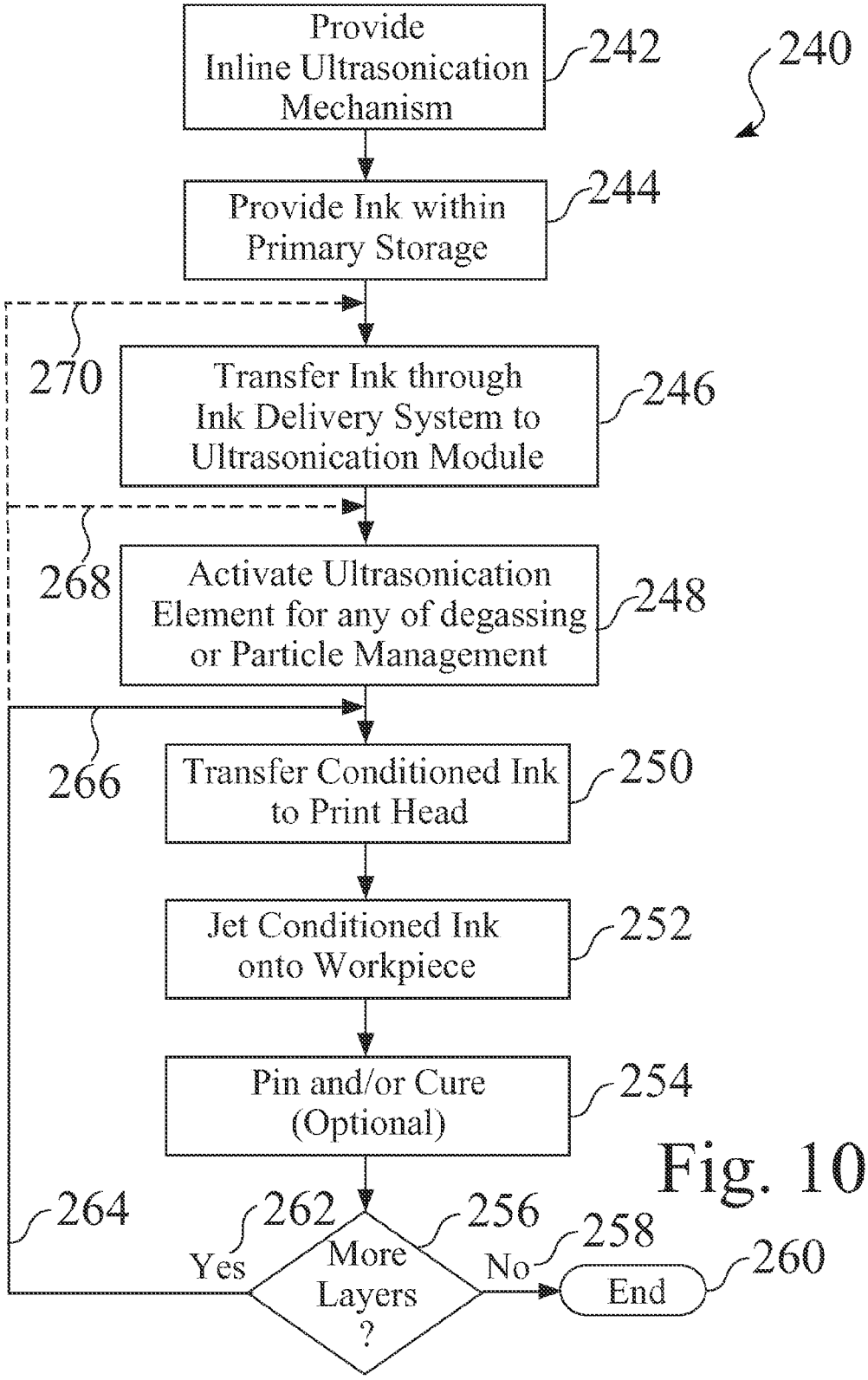
FIG. 10 is a flowchart of an exemplary process for ultrasonication of ink that is applied to create one or more layers on a work piece, e.g. a substrate.

FIG. 10 is a flowchart of an exemplary process 240 for the ultrasonic conditioning 136 of ink 44, before application of the conditioned ink 44*b* to create one or more ink layers 284, e.g. 284*a*-284*e* (FIG. 11) on a work piece 66. As seen in FIG. 10, one or more ultrasonication mechanisms 48, e.g. such as but not limited to a probe assembly 48*a* or a bath assembly 48*b*, are provided 242 anywhere within an ink distribution system for a printer, as desired. Within an established enhanced system 40, ink 44, e.g. 44*a*, is provided 244 for one or more channels, e.g. CYMK, such as within primary storage stations 42. In operation, the ink 44*a* is transferred 246 to the ultrasonication module 48. The ultrasonication mechanism 48 is activated 248 as desired, such as for any of ink degassing 50, particle management and/or particle preparation 52, or any combination thereof. The conditioned ink 44*b* is then transferred 250 to one or more print heads 26, where the conditioned ink 44*b* is controllably jetted onto the workpiece 66, such as directly to the workpiece 66, or onto a previously applied layer 284.

While the exemplary embodiments disclosed herein generally describe application of ink onto a workpiece 62, it should be understood that one more of the layers 284, e.g. 284*a* (FIG. 11), may be pinned or cured before the application of subsequent layers 284, e.g. 284*b*-284*e*. As further seen in FIG. 10, if it is determined 256 that there are no 258 further layers 284 to be printed, the process ends 260. If it is determined 256 that there is 262 at least one more layer 284 to be printed, the process returns 264, such as shown at 266, 268, or 270, as required, to proceed as necessary to print one or more additional layers 284.

Figure 11:
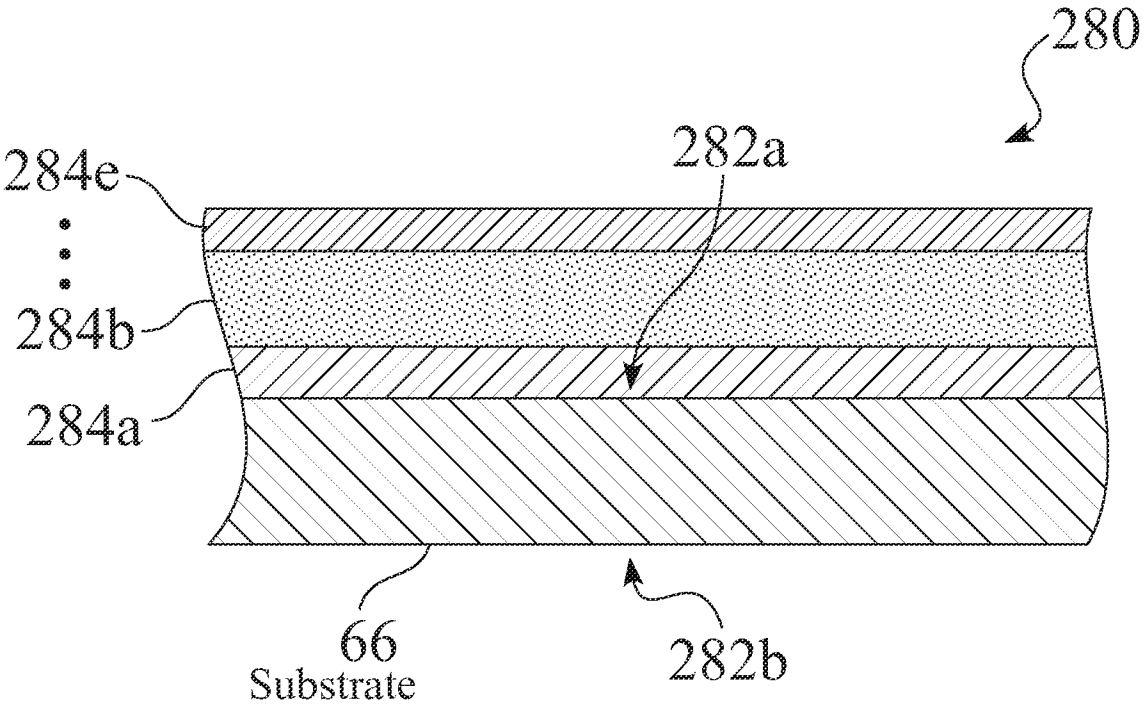
FIG. 11 is a partial cross section of an exemplary substrate having one or more jetted layers, wherein at least one of the layers has had ultrasonication applied to the ink before jetting onto the substrate.

FIG. 11 is a partial cross section 280 of an exemplary substrate 66 having one or more jetted layers 284, e.g. 284*a*-284*e*, wherein at least one of the layers 284 has had ultrasonication energy 136 applied to the ink 44 before being applied to the substrate 66. The exemplary substrate 66 seen in FIG. 11 comprises a first side 282*a*, and a second side 282*b* opposite the first side 282*a*, wherein the ink layers are applied to the first side 282*a*.

The application of ultrasonic energy 136 may preferably be used to condition a wide variety of inks 44, such as but not limited to any of:

- undercoats or primer layers;
- one or more color layers (CMYK, spot colors, opaque inks, translucent inks, tinted inks, clear inks, etc.);
- intermediate coatings;
- outer protective layers; or
- any combination thereof.

The enhanced ultrasonication systems 40, structures 48, and processes 240 may preferably be configured to re-disperse large particles 146 that have agglomerated over time, as the formation of particle agglomerates or clusters causes jetting issues. The reduction and maintenance of particles 146 is particularly useful where materials are prone to settling due to their high density.

The enhanced ultrasonication systems 40, structures 48, and processes 240 are particularly advantageous for printing environments that may benefit from dual-capability, comprising both ink degassing 50 and particle maintenance and/or preparation 52, e.g. for inkjet printing or for any type of printing.

The enhanced ultrasonication system 40 may preferably be configured to improve and maintain jet sustainability, by removing compressible gasses from an ink 44*a*. As the conditioned ink 44*b* is ejected from an inkjet nozzle, the prior removal of compressible gasses allows the conditioned ink 44*a* to be jetted efficiently.

As well, the enhanced ultrasonication systems 40, structures 48, and processes 240 may preferably be configured to efficiently break down, i.e. make smaller in size, pigment agglomerates 146, such as to maintain sufficiently small particle sizes that easily and reliably flow through an inkjet print head, thus avoiding the clogging of nozzles, which can otherwise lead to a printer failure mode.

Furthermore, the enhanced ultrasonication systems 40, structures 48, and processes 240 may be configured to apply ultrasonic energy to inks 44*a* that intentionally contain particles, e.g. metallic flakes, wherein the ultrasonic energy 136 may be configured to produce a conditioned metallic ink 44*b* having small particles 146, such as just prior to printing 62.

The enhanced ultrasonication systems 40, structures 48, and processes 240 may readily be provided for a wide variety of printers, depending on the efficacy. As well, the enhanced ultrasonication systems 40, structures 48, and processes 240 may be applied retroactively to a wide variety of existing printers, such as to improve print quality and reliability. Furthermore, the integration of enhanced ultrasonication systems 40, structure 48, and processes 240 that manage particle size of added particulates, e.g. metals, may increase the functionality of existing printers, allowing them to readily integrate new and improved ink products, such as to produce a wider spectrum of printed output.

The enhanced ultrasonication systems 40, structures 48, and processes 240 can therefore be configured to improve the sustainability of print heads, e.g. 60, and thus, of printer systems, e.g. 40.

Although the enhanced ink ultrasonication systems, structures and methods of use are described herein in connection with printing systems, the structures and techniques can be implemented for a wide variety of applications and environments, or any combination thereof, as desired.

For example, the enhanced ink ultrasonication systems, structures and methods of use may alternately be implemented for degassing and/or particle control for other environments that use inks, or for the degassing and/or particle control of other liquid mixtures, such as but not limited to paints, fuels, lubricants, foods and/or drinks.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

What is claimed is:

1. A printing system for conditioning ink, comprising:
an ink supply station for storing the ink;
at least one print head;
a delivery conduit comprising an ink chamber, said delivery conduit located between the ink supply station and the at least one print head; and
at least one ultrasonication assembly located within the delivery conduit, and extending into the ink chamber;
wherein the system is configured to deliver the ink from the ink supply station to the at least one ultrasonication assembly;
wherein the at least one ultrasonication assembly is configured to apply ultrasonic energy to the ink to condition the ink; and
wherein the system is configured to deliver the conditioned ink from the at least one ultrasonic assembly to the at least one print head;
wherein the ink contains metallic particles, and wherein the at least one ultrasonication assembly is configured to reduce the size of the metallic particles before delivery of the conditioned ink to the print head, wherein the print head is configured to deliver the conditioned ink having the reduced metallic particles onto a work piece.

2. The printing system of claim 1, wherein the ultrasonication assembly comprises an ultrasonic probe assembly.

3. The printing system of claim 1, wherein the ultrasonic energy has a characteristic frequency range of about 20 kHz to 400 kHz.

4. The printing system of claim 1, wherein the ink contains dissolved gas, and wherein the at least one ultrasonication assembly is configured to degas the ink, to improve jetting of the ink from the print head onto a work piece.

5. The printing system of claim 1, wherein the ink contains agglomerated particles, and wherein the at least one ultrasonication assembly is configured to reduce the size of agglomerated particles.

6. The printing system of claim 5, wherein the reduced size of the agglomerated particles prevents clogging of at least a portion of the print head.

7. The printing system of claim 1, wherein the at least one ultrasonication assembly is configured to contain the ink for a time period that is sufficient for any of ink degassing or breakdown of particles.

8. The printing system of claim 1, wherein the ink contains dissolved gas and particles, and wherein the at least one ultrasonication assembly is configured to degas the ink and to reduce the size of the particles.

9. An apparatus for conditioning ink, comprising:
a body comprising
a chamber defined therein,
an inlet port extending into the chamber for receiving ink from an ink supply station, and
an outlet port extending from the chamber for transporting ink from the chamber to a print head; and
an ultrasonication mechanism comprising an energy source extending into the chamber for delivering ultrasonic energy to the ink within the chamber;
wherein the ink contains metallic particles, and wherein the at least one ultrasonication assembly is configured to reduce the size of the metallic particles before delivery of the conditioned ink to the print head, wherein the print head is configured to deliver the conditioned ink having the reduced metallic particles onto a work piece.

10. The apparatus of claim 9, wherein the ultrasonication mechanism comprises an ultrasonic probe assembly.

11. The apparatus of claim 9, wherein the ultrasonic energy has a characteristic frequency range of about 20 kHz to 400 kHz.

12. The apparatus of claim 9, wherein the ink contains dissolved gas, and wherein the energy source is configured to degas the ink, to improve jetting of the ink from the print head onto a work piece.

13. The apparatus of claim 9, wherein the ink contains agglomerated particles, and wherein the energy source is configured to deliver sufficient ultrasonic energy to the ink reduce the size of the agglomerated particles.

14. The apparatus of claim 13, wherein the reduced size of the agglomerated particles prevents clogging of at least a portion of the print head from the ink.

15. The apparatus of claim 9, wherein the apparatus is configured to contain the ink in the chamber for a time period that is sufficient for any of ink degassing or breakdown of particles.

16. The apparatus of claim 9, wherein the ink contains dissolved gas and particles, and wherein the energy source is configured to degas the ink and to reduce the size of the particles.

17. A process, comprising the steps of:
providing an ultrasonication mechanism, wherein the ultrasonication mechanism comprises
a body comprising
a chamber defined therein, an inlet port extending into the chamber for receiving ink from an ink supply station, and an outlet port extending from the chamber for transporting ink from the chamber to a print head, and an energy source extending into the chamber for delivering ultrasonic energy to ink within the chamber;

delivering ink from a ink supply station to the chamber through the inlet port;

applying ultrasonic energy to the ink within the chamber to condition the ink;

transferring the conditioned ink from the chamber to a print head through the outlet port; and applying at least a portion of the conditioned ink to a workpiece;

wherein the ink contains metallic particles, and wherein the at least one ultrasonication assembly is configured to reduce the size of the metallic particles before delivery of the conditioned ink to the print head, wherein the print head is configured to deliver the conditioned ink having the reduced metallic particles onto a work piece.

18. The process of claim 17, wherein the ultrasonication mechanism comprises an ultrasonic probe assembly.

19. The process of claim 17, wherein the ultrasonic energy has a characteristic frequency range of about 20 kHz to 400 kHz.

20. The process of claim 17, wherein the ink contains dissolved gas, and wherein the energy source is configured to degas the ink, to improve jetting of the ink from the print head onto a work piece.

21. The process of claim 17, wherein the ink contains agglomerated particles, and wherein the energy source is configured to deliver sufficient ultrasonic energy to the ink reduce the size of the agglomerated particles.

22. The process of claim 21, wherein the reduced size of the agglomerated particles prevents clogging of at least a portion of the print head from the ink.

23. The process of claim 17, wherein the ultrasonication mechanism is configured to contain the ink in the chamber for a time period that is sufficient for any of ink degassing or breakdown of particles.

24. The process of claim 17, wherein the ink contains dissolved gas and particles, and wherein the energy source is configured to degas the ink and to reduce the size of the particles.

* * * * *